US005676711A

United States Patent [19]

Kuzara et al.

[11] Patent Number: 5,676,711

[45] Date of Patent: Oct. 14, 1997

[54] OIL CONVERSION PROCESS

[76] Inventors: Joseph K. Kuzara, P.O. Box 25; Larry D. Klinger, 1117 1st St. West, both of Roundup, Mont. 59072

[21] Appl. No.: 604,399

[22] Filed: Feb. 21, 1996

[51] Int. Cl.[6] ..... C10L 1/02; C10G 1/00

[52] U.S. Cl. ..... 44/622; 44/62; 208/85; 208/106; 208/126; 208/179; 208/211; 208/213; 208/430; 208/434

[58] Field of Search ..... 44/281, 622, 620; 208/430, 434, 85, 179, 106, 126, 211, 213

[56] References Cited

U.S. PATENT DOCUMENTS 3,870,621 3/1975 Arnold et al. .
4,334,976 6/1982 Yan .
4,541,916 9/1985 Beuther et al. .
4,853,111 8/1989 MacArthur et al. .
5,049,258 9/1991 Keim et al. ..... 208/106
5,253,469 10/1993 Hodrien et al. .
5,255,504 10/1993 Hodrien et al. .
5,287,695 2/1994 Schneider .
5,327,717 7/1994 Hauk .
5,338,322 8/1994 Ignasiak et al. .

*Primary Examiner*—Margaret Medley
*Attorney, Agent, or Firm*—Richard C. Conover

[57] ABSTRACT

An improved process for producing a low-sulfur fuel oil or gas from used oil and finely divided coal. After mixing, the coal/oil slurry is heated within a pressure vessel to a temperature of approximately 850° F. and the pressure increased to approximately 1500 psi for a time period of more than one hour. A gaseous low-sulfur diesel fuel can be recovered from near the top of the pressure vessel.

4 Claims, 1 Drawing Sheet

OIL CONVERSION PROCESS

BACKGROUND OF THE INVENTION

This invention relates to an improved process for producing a low-sulfur fuel oil or gas from "used" oil and coal.

The term "used" oil, as opposed to "waste" oil, is defined as oil which has been refined from crude petroleum, used for its intended purpose, and subsequently declared by its user as no longer suitable for its intended purpose. Used engine oil, turbine oil, gear lubricants, hydraulic and transmission fluids, metalworking fluids such as cutting, grinding, machining, rolling, stamping, quenching and coating oils, and insulating or coolant oils are suitable candidates for disposal as "used" oil. "Waste" oil on the other hand, by definition of the Environmental Protection Agency (EPA), is oil which has not been used for anything but which is no longer desired. Although "waste" oil could be a feedstock in some cases, attention is directed at obtaining an economic benefit from "used" oil which has fulfilled its intended purpose and now awaits disposal.

Because of the wide variety of oils that can be considered as "used" oils, it is impossible to accurately quantify the composition of a "used" oil other than to say that it is probably contaminated to such an extent that it is no longer desirable, or suitable, for its originally intended purpose.

Responsible users of lubricating, power transmission, or industrial oils typically collect and store their "used" oils in tanks or drums without separating the oils according to type. Such oils may contain dirt and carbon originating from the process of combustion in an engine, as well as unburned portions of various engine fuels such as gasoline, diesel, or jet fuels. Moreover these "used" oils may contain different levels of metals coming from an engine or machine, materials associated with a machine's construction, or lead from additives in various fuels. In addition, "used" oils can contain substances like solvents used in cleaning machine parts, refrigerants or coolants which leak by seals, and other contaminants which enter the oil as a result of repair operations.

With rare exceptions, lubricating, power transmission, and industrial oils all contain numerous additives to improve their performance in a specified application. These additives take the form of substances such as oxidation inhibitors, viscosity index improvers, pour point depressants, detergents and dispersants, extreme pressure additives, friction modifiers, antifoam agents, demulsifiers, corrosion inhibitors, and others. Given the vast array of substance compositions available to achieve these performance enhancements, and because these additives are often proprietary in nature, the user of a particular oil is extremely unlikely to know exactly what an oil contains before he or she uses it, much less after the oil is used and it becomes "used" oil awaiting disposal.

It can be seen then, that a "used" oil, which constitutes one of the two necessary materials for the present invention, presents a bewildering conglomeration of processed crude oil fractions and artificial additives which defy consistency. No meaningful description can be offered as to its chemical composition.

The disposal problem associated with "used" oil is rather significant and is a driving force behind the present invention. In a study, "Perspectives on the Generation and Management of Used Oil in the United States in 1991," prepared by Clayton Environmental Consultants, Lexington, Mass., (updated March 1993) estimates were made that 1.38 billion gallons of "used" oil were generated in the United States in 1991. A subset of this total, a portion totalling about 190 million gallons, was disposed of illegally or used for road oiling to suppress dust. Some of the remaining disposal processes for the "used" oil involve re-refining so as to be used for lubricating-oil feedstocks. The largest amount of "used" oil entering the formal "used" oil management system has been burned in space heaters, industrial boilers, or used in marine applications where any contaminants or oil additives were left in the mixture prior to combustion.

The other substance, used in the present invention as a feedstock, is coal. There have been several processes described in the literature to recover liquid fuels from a mixture of coal and oil feedstocks. U.S. Pat. No. 3,870,621 to Arnold et al. describes a process for using high boiling hydrocarbon oil (notice the "used" oils as described above are not used as a feedstock) mixed with coal to convert the mixture to naphthas and gas oils. The petroleum fraction feedstock has a boiling point in excess of 700° F. This invention produces low-boiling point oils from high-boiling point oil feedstock in a low pressure environment of 10–100 psi. The resulting char also has a relatively low sulfur content, a result which is opposite to the output of the present invention.

U.S. Pat. No. 4,334,976 to Yan describes a process using coal which requires the several steps of heating, cooling, and separating to demetal a feedstock of "heavy hydrocarbon oil" to produce gas and liquid constituents. The "heavy hydrocarbon oil" feedstock has a boiling point in excess of 700° F.; sulfur is not discussed.

U.S. Pat. No. 4,541,916 to Beuther et al. describes a process for converting coal to gas and liquid constituents from a feedstock which has vanadium plus nickel available as contaminants and of which over 50% has a boiling point greater than 600° F. A sulfur analysis was done on the feedstocks, but none was described in the patent concerning the output products. The process does require vanadium plus nickel contaminants in the feedstocks.

U.S. Pat. No. 4,853,111 to MacArthur et al. describes a two-stage process which requires both a catalyst and additional hydrogen to produce gas and solid constituents. The input feedstock is a heavy oil which has at least 90% of the volume boiling above 650° F. Again a sulfur analysis was done on the feedstocks, but none was described in the patent concerning the output products.

U.S. Pat. No. 5,338,322 to Ignasiak uses "heavy oil" sometimes mixed with a light hydrocarbon diluent which can only be at a maximum of 50% of the weight of the coal. Much more coal than oil is used in this process to produce distillable oil; sulfur was not discussed.

The patents discuss above are not concerned with concentrating sulfur in one of the output products of the invention. Low sulfur concentration in the primary output of the process is a virtue, as sulfur is detrimental to engine/burner/boiler components and upon combustion forms $SO_x$ compounds. These compounds are corrosive with undesirable air pollutants. To establish a context for the term "low-sulfur": coal generally has a sulfur content ranging between 0.46% and 0.64% by weight; lube oils generally contain a sulfur concentration of anywhere between 0.2% and 4.5%; ordinary turbine/diesel fuels generally have a sulfur content of between 0.3% and 0.55%. The term "low-sulfur" as used in this application shall mean a product which has a sulfur content below 0.2% by weight, which is a lower percentage of sulfur by weight than that occurring in any of the feed stocks being input into the process.

From the above, it can be seen that none of the inventions described use "used" oil as a feedstock nor do they utilize a simple processes to recover useful products from this "used" oil. A process to reprocess "used" oil would be more useful if it did not use catalysts, and also accepted any of the variously composed "used" oils presently available as feedstock. The flammable gaseous fuel recovered from the process should also have a lower-sulfur content by weight than any of the feedstocks being input into the process.

SUMMARY OF INVENTION

The present invention is directed to a continuous process of making a gaseous low-sulfur fuel, condensing to slightly lighter than #2 diesel fuel. The gaseous fuel is made from the heat and pressure treatment of a slurry of "used" oil and sub-bituminous coal fines. "Used" oil is mixed in approximately equal portions with coal graded so that at least 90% of the coal is less than 200 mesh (74 microns). After mixing, the coal/oil slurry is divided into two portions: one portion being pumped into a pressure vessel, and the other portion being diverted to a burner unit to supply process heat to the pressure vessel.

Within the pressure vessel, the coal/oil slurry is heated to a temperature of approximately 850° F. and the pressure increased to approximately 1500 psi by heating the slurry. The products of reaction of the coal/oil slurry in the pressure vessel forms two distinct products. Near the bottom of the vessel, a flammable solid residue containing most of the sulfur is continuously withdrawn and is fed to the burner as a fuel augmenter. Near the top of the vessel, a flammable gaseous product, which is very low in sulfur, is withdrawn and is either used directly, or condensed to a liquid slightly lighter than #2 diesel fuel and stored for later use in devices like engines or turbines.

BRIEF DESCRIPTION OF THE DRAWING

In order that the invention may be clearly understood and readily carried into effect, a preferred embodiment of the invention will now be described, by way of example only, with reference to the accompanying drawing wherein.

DESCRIPTION OF A PREFERRED EMBODIMENT

Figure 1:
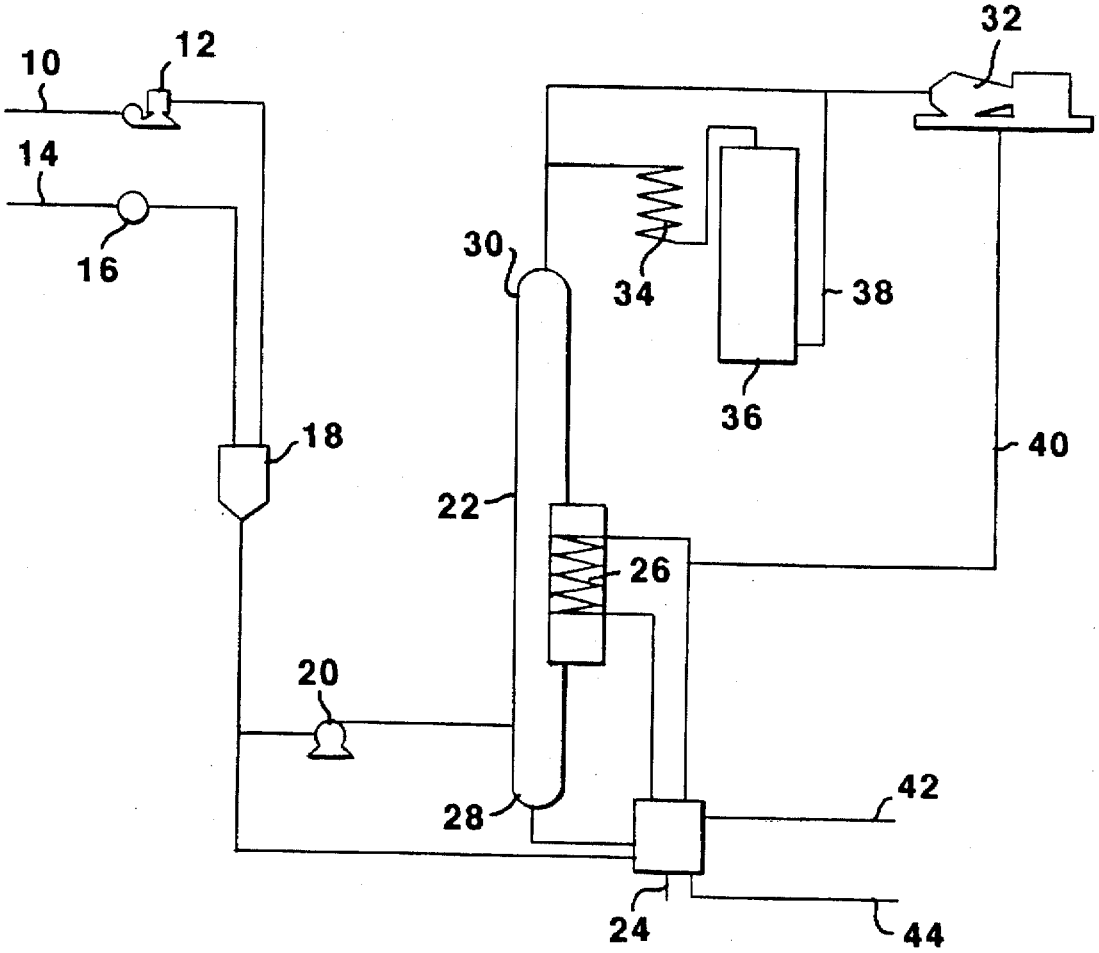
FIG. 1 is a schematic diagram illustrating a continuous process for converting "used" oil and coal feedstock into useful gaseous, liquid, and solid products.

A preferred embodiment of the present invention is shown as a continuous process in FIG. 1. Coal fines 10 are fed into a pulverizer 12, which in the preferred embodiment is a Raymond Mill, where the coal is crushed to the point that approximately 90% will pass through a 200 mesh screen (74 microns). The coal used in a preferred embodiment is classified as a sub-bituminous-B type, although other bituminous or sub-bituminous coals could be used. It is also contemplated that a carbonaceous substance containing cellulose and lignin could also be substituted for the coal.

"Used" oil 14 is piped through a filter 16. The present invention uses "used" oil which satisfies the requirements of a non-hazardous substance and which has an indeterminate chemical composition and widely varying physical characteristics. The mixtures of "used" oils processed generally boil in the range 200° C. to 650° C., range in density from approximately 0.85 to 1.2 g/ml at 15° C., and contain relatively small amounts of lighter crude oil distillates such as gasoline, diesel fuel, jet fuel, and so forth.

Both coal 10 and "used" oil 14 are introduced in approximately equal portions by weight to mixer 18, which uses ordinary ribbon or paddle type mixers, to form a coal/oil slurry. The slurry is stirred continuously to avoid separation. When the coal/oil slurry exits mixer 18, a first portion is supplied to a pump 20, a piston type pump in a preferred embodiment, which is used to charge pressure vessel 22 on a continuous basis. A second portion of the coal/oil slurry exiting mixer 18 is diverted to a burner unit 24 which supplies process heat to pressure vessel 22.

Within pressure vessel 22, the coal/oil slurry is heated to a temperature of approximately 850° F. Heat is generated from burner unit 24 and conveyed, by using heat exchanger 26, into pressure vessel 22. Heating a gas in a closed vessel causes the pressure to build so that no additional gas need be added to pressure vessel 22. In a preferred embodiment, the pressure is controlled at approximately 1500 psi. Also in the preferred embodiment, the coal/oil slurry has a residence time in pressure vessel 22 of not less than 1 hour which translates to an equivalent space velocity on a per gallon volume per hour of residence time of approximately $1.051\times 10^{-6}m^3$/second.

When the coal/"used" oil slurry is heated under pressure, certain chemical reactions take place. A flammable solid residue, resulting from the heating, is continuously withdrawn through pressure-reducing valves from near the bottom of pressure vessel 22, shown as location 28 in FIG. 1, and fed to burner 24 as a fuel augmenter. This flammable solid residue contains most of the sulfur present in the incoming coal/oil slurry.

Near the top of pressure vessel 22 at location 30, a flammable gaseous product under pressure is then continuously bled off. This gaseous product is very low in sulfur. The flammable gaseous product withdrawn at 30 can be condensed to a liquid, slightly lighter than #2 diesel fuel, by passing the gas through condenser 34.

To further illustrate the continuous process described above, a batch experiment was conducted to demonstrate the workability. The experiment which follows should not be considered as limiting the invention but rather only as exemplary of various embodiments that could be developed based upon the laboratory results obtained.

EXPERIMENTAL CHEMICAL EVENTS

The batch experiment was set up as follows:

1. Coal Sample Preparation. A raw coal sample was randomly collected from a pile at an underground coal mine. The coal was hand ground and then screened through a 200 mesh screen (ATM) meeting A.S.T.M.E-11 specification and having openings measuring 0.0029 (74 microns).
2. Oil Sample Preparation. A random sample of "used" oil was drawn from an oil storage tank used in daily "used" oil pick-up operations. The oil sample was then drip filtered through a Number 1 (11 micron+retained) Whatman filter and then through a Number 2 (8 micron+retained) Whatman filter. A third filtration was accomplished using a Whatman GFD (Glass Micro-Filter) which retains particles larger than 2.8 microns.
3. Slurry Preparation. Equal amounts by weight of "used" oil and coal fines were blended together and kept continually mixed. The slurry was placed in a container.
4. Pressure Vessel. A small pressure vessel was machined to hold pressures in excess of 10,000 psi. The vessel had a cavity to hold the container with the "used" oil and coal fines to be tested. In addition, openings through the top of the pressure vessel were in fluid communication with the cavity to provide tubular passages for a thermocouple to measure slurry temperature as well as insert inert nitrogen gas, and a tubular passage to recover the gaseous products of the reaction filling the cavity.

5. Heat system. A controllable propane burner, with a thermocouple to measure actual flame temperature, was installed below the pressure container. A burner flame temperature of approximately 1,300° F. elevated and maintained the pressure vessel inside temperature at 850° F. This was the design temperature used for the experiment.
6. Pressurizing System. Inert nitrogen gas, pressurized at 3000 psi, was connected to the pressure vessel cavity for the batch experiment to keep the slurry mixed, and to prevent the "used" oil from boiling too early by virtue of the initial low pressure existing in the pressure vessel. A continuous system would not need this inert gas pressurizing system, as fumes from the hot coal/"used" oil slurry in the continuous system would keep the system pressurized.
7. Collection System. A tube, having a simple air-cooled condensing coil, extended into the cavity in the pressure vessel at one end. At the distal end, the tube was placed in a simple, unstoppered laboratory flask so as to collect reaction products.
8. Monitoring System. A pressure gauge was mounted on an apparatus control panel in order to monitor the system pressure. In addition, a simple manually switched electronic temperature read-out device presented either burner temperature or slurry temperature as desired by an operator.

Actual Experiment

A slurry composed of 50 grams of "used" oil and 50 grams of coal fines were blended together and placed in a container. The slurry was continuously hand stirred in order to minimize separation of the mixture. The container with the mixed slurry was then placed inside the pressure vessel with one of the tubes extending down through the lid of the pressure vessel and on into the "used"oil/coal slurry. Inert gas at 1500 psi was introduced through this tube to check for leaks and, by virtue of the entering gas bubbling through the slurry, to keep the coal in suspension with the oil during the early stages of the experiment.

An initial nitrogen test pressure (1500 psi) was bled off to a level of 660 psi at which time propane burning within the burner was initiated. As the vessel temperature increased, of course, the system pressure increased. The experimental temperature/pressure relationship was tracked with a previously calculated ideal gas P-V-T chart in order to determine how close to an ideal (theoretical) curve the actual curve would fit. The ideal gas relationship was used to derive an approximate initial system pressure. A pressure design criteria was to begin with a pressure and temperature such that the coal/oil slurry would be below the slurry boiling point. A second pressure criteria was to achieve 1500 psi within the pressure vessel at approximately the same time as the temperature reached 850° F. to avoid having to add gas pressure as the experiment progressed.

The burner temperature was adjusted to 1,300° F. after it was ignited with the plan being that this burner temperature should develop a pressure vessel temperature at about 850° F.

A 660 psi initial pressure was found to be excessive as vessel pressure increased more rapidly than had been anticipated, and pressure subsequently had to be bled off when pressure reached 1500 psi at a temperature of 755° F.

At 784° F. and 1420 psi pressure, both pressure and temperature began fluctuating. Temperature would rapidly drop to about 740° F. and then increase again, while pressure would increase to about 1480 psi and then drop again. These fluctuations were experienced for a period of about 15 minutes, after which both again became stabilized and continued to rise to the desired levels where they were maintained without incident for a period of 1 hour.

It is believed that the pressure/temperature fluctuations were the result of early stages of pyrolytic decomposition of the coal particles during which coal molecules are known to "swell" as their electron bonds are severed in the absence of oxidation. It is also believed that heat is absorbed during this "swelling" which represents the energy required to break the molecular bonds.

While a temperature was maintained at 850° F. for the period of one hour, the outlet valve to the system was periodically manipulated to maintain a 1500 psi pressure.

During this periodic bleed-off of pressure, products of the reaction were condensed in the tube coil and captured in the flask in liquid form. After 1 hour processing time, the propane flame was extinguished and the pressure vessel allowed to cool. During the early stages of this cooling-off period, the outlet valve continued to be manipulated to continue capturing gaseous reaction products.

These gaseous products variously possessed the distinctive odor of gasoline/diesel fuel and coal gas. The gaseous products which condensed into a fluid form appeared as a transparent, very light yellow colored, oily liquid being condensed from a white, smoky vapor.

At the beginning of the experiment, the gross weight of the container of oil/coal mixture inside the pressure vessel weighed 305 grams. The tare weight of the container alone was 205 grams. At the conclusion of the experiment, the gross weight of the container and flammable solid residue was 223 grams. This meant 18 grams of reactants remained in the container, and 82 grams of gaseous reactant products had been liberated. However the weight of products captured as fluid condensate amounted to only 68 grams. Accounting for the difference between the 82 grams and the 68 grams, the 24 grams lost escaped partially as gasses to the atmosphere, and partially as remainder in the apparatus piping, valve, rupture disc holder, etc.

The solid 18 grams remaining in the container were observed to be a moist, finely granulated material contrasting to the original coal sample in that it was more dense black in color and was not dry. It also possessed a distinctive odor of hydrocarbon volitiles. A small amount was removed and subjected to an open flame. The vapors emitted therefrom were found to be quite flammable. The remaining quantity was heated at low temperature over a Bunsen burner in open air until it appeared quite dry. On a dry basis then, the non-volatile portion was found to weigh 8 grams, meaning that approximately 10 grams had been driven off.

From this, it was deduced that the total fluid/gas products of reaction amounted to approximately 92 grams, or 92 percent, of the original weight of the reactants. Since the actual content and disposition of the 24 grams not recovered was not known, it was believed that as a minimum, 68 grams was a valid quantity as recovered product of the reaction.

Therefore, the known recoverable products under this set of experimental conditions was deduced to range between 68 and 92 percent.

A sample of the 68 grams of liquid recovered was submitted to a testing laboratory for analysis. According to the report received from the lab, the sample was subjected to several analyses on an "as is" basis.

The results of a sulfur analysis performed by oxygen combustion followed by colorimetic finish to barium sulfate produced a result of 0.08 percent sulfur by weight of the gaseous product. With this low percentage of sulfur, it was obvious that the flammable gaseous fuel recovered in the present process resulted in a low-sulfur product much lower than any of the feedstocks. Because the gas had such a low sulfur content, it was deduced that the flammable solid residue contained most of the sulfur that entered in the form of the coal/"used" oil slurry.

The results of several analyses by Flame Ionization Detector (FID) gas chromatography produced the description of the gaseous products condensed to liquids, as consisting of n-paraffins ranging from the C-7's (Heptanes) through C-20 (Eicosane). Several runs of the sample spiked with Diesel Range Organics (DRO) standards that verified the marked C-10 through C-20 FID gas chromatograph peaks.

The experiment demonstrated that a low-sulfur fluid, slightly lighter than #2 diesel fuel, could be condensed from the flammable gaseous products resulting from the "used oil" conversion process.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

We claim:

1. A process for converting used oil to a low-sulphur diesel fuel comprising:

filtering used oil to produce filtered used oil with particles more than 11 microns in size removed;

mixing the filtered used oil and coal, graded to less than 74 microns, in approximately equal portions by weight to form a coal/oil slurry;

heating the coal/oil slurry in a pressure vessel to a temperature of approximately 850° F. under a pressure of approximately 1500 psi for a time period of more than 1 hour;

recovering a gaseous low-sulphur diesel fuel from near the top of the pressure vessel; and condensing the gaseous low-sulphur diesel fuel to liquid slightly lighter than #2 diesel fuel.

2. A process in accordance with claim 1 wherein the coal is bituminous.

3. A process in accordance with claim 1 wherein the coal is sub-bituminous.

4. A process in accordance with claim 1 wherein used oil boils in the range 200° C. to 650° C., ranges in density from 0.85 to 1.2 gm/ml at 15° C.

* * * * *